US007513134B2

(12) United States Patent
Hashimoto et al.

(10) Patent No.: US 7,513,134 B2
(45) Date of Patent: Apr. 7, 2009

(54) CASE FOR REMOTE CONTROL KEY

(75) Inventors: Masashi Hashimoto, Aichi (JP); Tokio Shimura, Kariya (JP); Mitsuru Nakagawa, Kariya (JP)

(73) Assignees: Kabushiki Kaisha Tokai Rika Denki Seisakusho, Aichi (JP); Denso Corporation, Aichi-Ken (JP)

( * ) Notice: Subject to any disclaimer, the term of this patent is extended or adjusted under 35 U.S.C. 154(b) by 0 days.

(21) Appl. No.: 11/958,166

(22) Filed: Dec. 17, 2007

(65) Prior Publication Data

US 2008/0105015 A1 May 8, 2008

Related U.S. Application Data

(62) Division of application No. 11/096,243, filed on Mar. 31, 2005, now Pat. No. 7,310,980.

(30) Foreign Application Priority Data

Apr. 2, 2004 (JP) ..... 2004-110193

(51) Int. Cl.
*A44B 15/00* (2006.01)

(52) U.S. Cl. ..... 70/456 R; 70/408; 70/252; 70/63; 70/57.1

(58) Field of Classification Search ..... 70/63, 70/456 R, 408, 252, 459, 57.1
See application file for complete search history.

(56) References Cited

U.S. PATENT DOCUMENTS

| | | | | |
|---|---|---|---|---|
| 5,388,691 | A | 2/1995 | White | |
| 5,544,510 | A | 8/1996 | Botteon et al. | |
| 5,561,331 | A | 10/1996 | Suyama et al. | |
| 7,231,790 | B2 * | 6/2007 | Tonelli | 70/33 |
| 7,260,962 | B2 * | 8/2007 | Lax et al. | 70/57.1 |
| 2003/0131638 | A1 * | 7/2003 | Chang | 70/57.1 |
| 2004/0177657 | A1 * | 9/2004 | Kim | 70/57.1 |
| 2004/0182119 | A1 * | 9/2004 | Lax et al. | 70/57.1 |
| 2004/0237613 | A1 | 12/2004 | Shimura et al. | |
| 2005/0166650 | A1 | 8/2005 | Shimura et al. | |
| 2006/0081020 | A1 * | 4/2006 | Hsiao et al. | 70/57.1 |
| 2006/0150696 | A1 | 7/2006 | Eychenne et al. | |
| 2006/0260370 | A1 | 11/2006 | Miwa et al. | |
| 2007/0044525 | A1 | 3/2007 | Katagiri et al. | |

FOREIGN PATENT DOCUMENTS

| | | |
|---|---|---|
| JP | 2002/322841 | 11/2002 |
| JP | 2003/113683 | 4/2003 |

* cited by examiner

*Primary Examiner*—Suzanne D Barrett
(74) *Attorney, Agent, or Firm*—Patterson, Thuente, Skaar & Christensen, P.A.

(57) ABSTRACT

A portable remote control key case including a first case shell and a second case shell that are securely fastened to each other. The case includes a case body, which has a component chamber and a key socket, and a mechanical key, which is partially received in the key socket. First and second engagement projections are formed extending across a boundary between the first and second case shells. The mechanical key includes clamp portions for clamping the first and second engagement projections.

9 Claims, 6 Drawing Sheets

CASE FOR REMOTE CONTROL KEY

RELATED APPLICATIONS

This application is a divisional of Application No. 11/096,243 filed Mar. 31, 2005, which claims the benefit to Japanese Application No. 2004-110193 filed Apr. 2, 2004, the disclosures of which are hereby incorporated by reference.

BACKGROUND OF THE INVENTION

The present invention relates to a case for a remote control key that communicates with a drive controller, which locks and unlocks a lock device, to remotely control the lock device.

In recent years, lock devices for use in doors of vehicles and houses are locked and unlocked through remote control. For example, a remote control system has been proposed for locking and unlocking a lock device when a portable device is operated, which is provided with a communication function. A portable device used in a conventional remote lock system outputs a wireless signal including an 10 code when operated by a user. A drive controller, which electrically drives the lock device, receives the wireless signal from the portable device and executes a command (lock command or unlock command) in accordance with an ID code included in the wireless signal. For example, with a portable device for a keyless entry system, the user approaches a vehicle and pushes an unlock button of the portable device near the vehicle to unlock the door of the vehicle.

Japanese Laid-Open Patent Publication Nos. 2003-113683 and 2002-322841 describe portable devices used in smart entry systems. In a smart entry system, a user holding the portable device approaches a vehicle to unlock the vehicle door and moves away from the vehicle to lock the vehicle door. A mechanical key is retainable in the portable device.

The portable device of the prior art includes a case body, which is formed by a first case shell and a second case shell, and a circuit board, which is accommodated in the case body. Communication circuits and control circuits are formed on the circuit board. The first and second case shells have a snap-fit structure so that they can be snapped together. A rubber packing is arranged between the two case shells so that the portable device has high water resistance. When a case is formed by fastening first and second case shells to each other through a snap-fit structure, creep deformation may occur in the snap-fit structure due to the effects of wear and temperature. This reduces the fastening force of the two case shells. The reduction in the fastening force may lower the water resistance of the two case shells or cause the two case shells to fall apart.

SUMMARY OF THE INVENTION

It is an object of the present invention to provide a case body for a portable device that is formed by easily and securely fastening first and second case shells.

One aspect of the present invention is a case for a portable device, in which the portable device includes a communication apparatus for communicating with a drive controller that electrically locks and unlocks a lock device to remotely control the lock device. The case is provided with a case body including a component compartment, for accommodating the communication apparatus, and a socket, having an opening. The case body is formed by fastening a first case shell and a second case shell, which have a snap-fit structure, to each other. A mechanical key mechanically operates the lock device. The mechanical key is partially received in the socket.

An engagement projection is formed near the opening of the socket and extends across a boundary between the first and second case shells. A clamp portion is arranged on the mechanical key for clamping the engagement projection.

Another aspect of the present invention is a case for a portable device, in which the portable device includes a communication apparatus for communicating with a drive controller that electrically locks and unlocks a lock device to remotely control the lock device. The case is provided with a case body including a component compartment, for accommodating the communication apparatus, and a socket, having an opening. The case body is formed by fastening a first case shell and a second case shell, which have a snap-fit structure, to each other. An attachment is detachably attached to the case body. The attachment is partially received in the socket. An engagement projection is formed near the opening of the socket and extends across a boundary between the first and second case shells. A clamp portion is arranged on the attachment for clamping the engagement projection.

A further aspect of the present invention is a case for a portable remote control key. The portable remote control key includes a communication apparatus for communicating with a drive controller that electrically locks and unlocks a lock device to remotely control the lock device. The case includes a first case shell having a joining surface and a side surface. A second case shell has a joining surface and a side surface and defines a component compartment, for accommodating the communication apparatus, and a socket, having an opening, in cooperation with the first case shell. The joining surface of the second case shell comes into contact with the joining surface of the first case shell when the second case shell is fastened to the first case shell. The side surface of the second case shell is flush with the side surface of the first case shell when the second case shell is fastened to the first case shell. A first projection is formed on the side surface of the first case shell. A second projection is formed on the side surface of the second case shell. The second projection cooperates with the first projection to form an engagement projection extending across a boundary between the first and second case shells. A plug is received in the socket to close the socket. The plug includes a clamp portion for clamping the engagement projection to fasten the first and second case shells each other.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may "best be understood by reference to the following description of the presently preferred embodiments together with the accompanying drawings in which.

DETAILED DESCRIPTION OF THE INVENTION

A case for a portable device according to a first embodiment of the present invention will now be discussed with reference to FIGS. 1 to 5.

Figure 1:
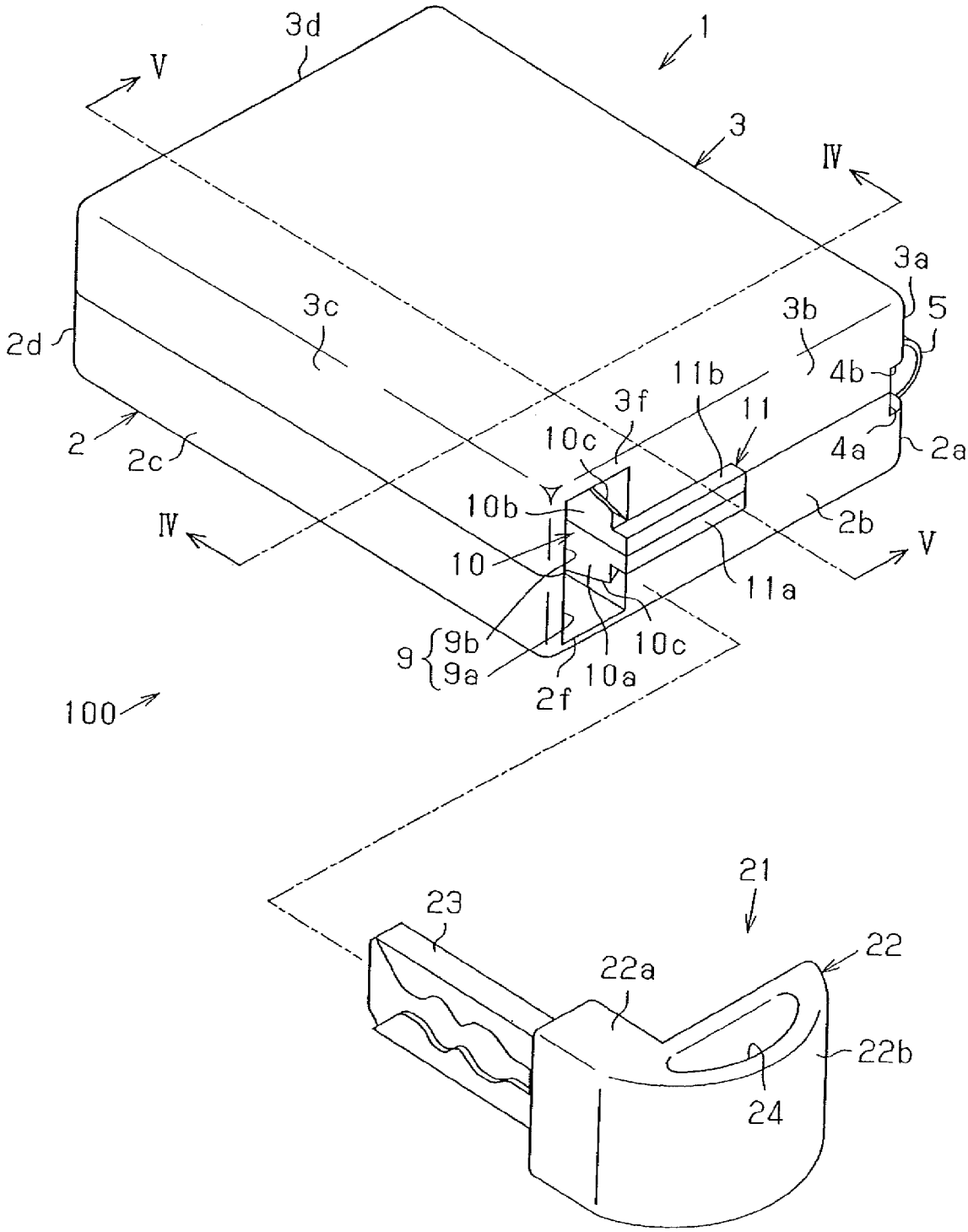
FIG. 1 is a perspective view showing a portable device according to a first embodiment of the present invention.
Figure 2:
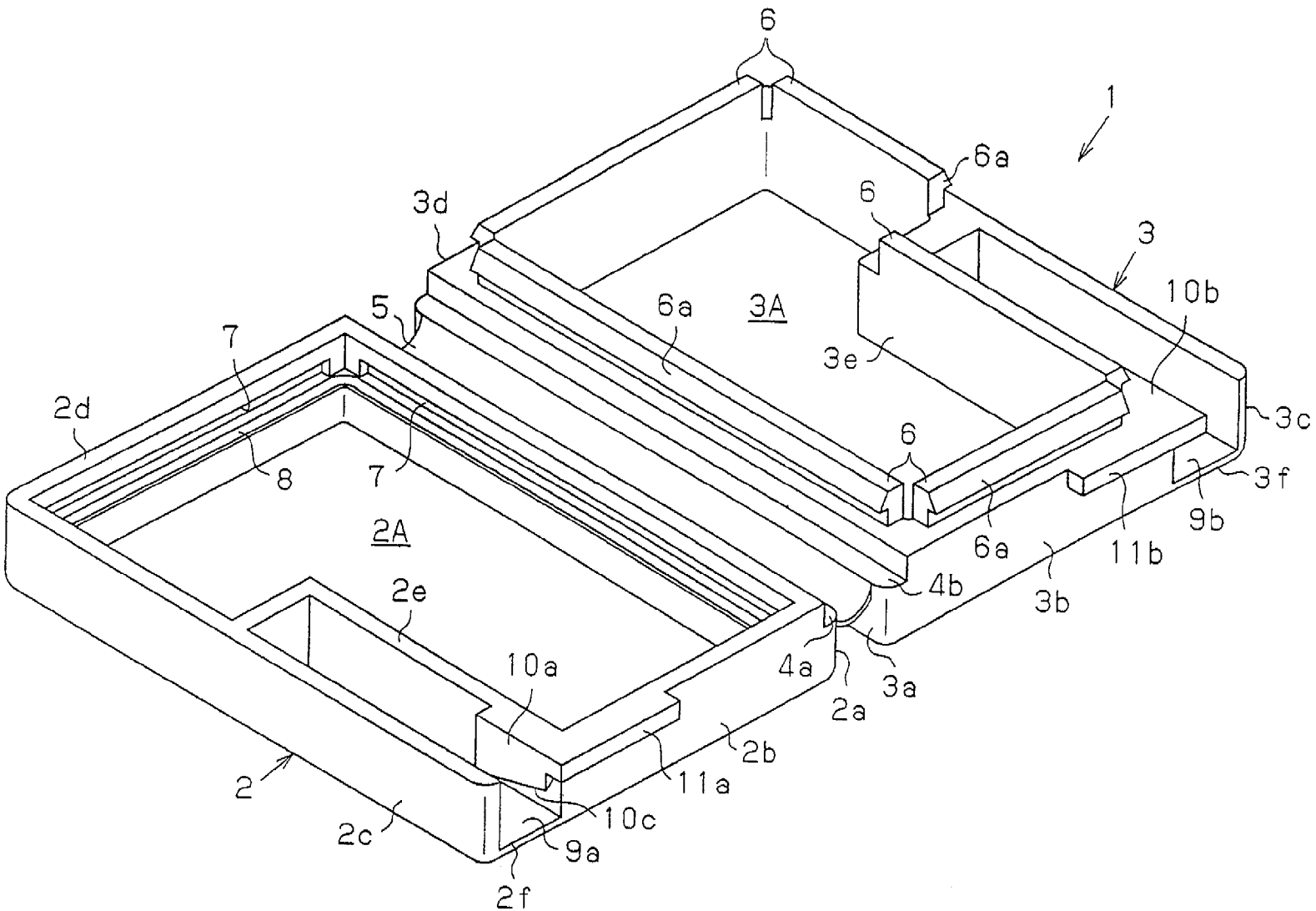
FIG. 2 is a perspective view showing a case body of FIG. 1 in an opened state.

Referring to FIGS. 1 and 2, the case 100 of the portable device (remote control key) includes a case body 1 and a mechanical key 21. The case body 1 is formed by fastening a first case shell 2 and a second case shell 3 to each other. The first case shell 2 and the second case shell 3 are symmetric to each other and respectively have cavities 2A and 3A. The first case shell 2 includes first to fourth outer walls 2*a* to 2*d* and a partition wall 2*e*. The second case shell 3 includes first to fourth outer walls 3*a* to 3*d* and a partition wall 3*e*. In one embodiment, when the first case shell 2 is fastened to the second case shell 3, the outer walls 2*a* to 2*d* of the first case shell 2 are flush with the outer walls 3*a* to 3*d* of the second case shell 3, respectively.

A hinge 5 is formed between the first and second case shells 2 and 3. The hinge connects a stepped portion 4*a*, which is defined in the vicinity of a joining surface extending along the first outer wall 2*a* of the first case shell 2, and a stepped portion 4*b*, which is defined in the vicinity of a joining surface extending along the first outer wall 3*a* of the second case shell 2. The case shells 2 and 3 pivot about the hinge 5 relative to each other. When the joining surfaces of the case shells 2 and 3 come into contact with each other, cavities 2A and 3A cooperate with each other to define a component compartment. Electronic components including a communication circuit (not shown) are accommodated in the component compartment. In the first embodiment, the component compartment is L-shaped.

Figure 4:
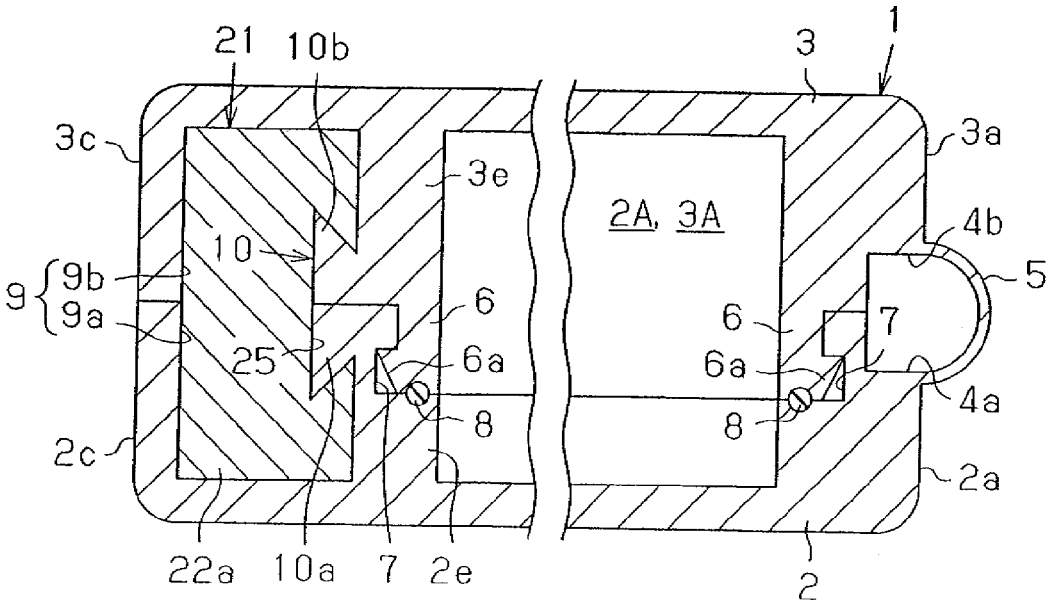
FIG. 4 is a cross-sectional view taken along line IV-IV in FIG. 1.

As shown in FIG. 2, inner walls 6 project from the upper surfaces of the first to fourth outer walls 3*a* to 3*d* and partition wall 3*e* of the second case shell 3. Each inner wall 6 has a hook 6*a*. Engagement grooves 7 are formed in the inner surfaces of the first to fourth outer walls 2*a* to 2*d* and partition wall 2*e* of the first case shell 2 to engage an associated one of the hooks 6*a*. Referring to FIG. 4, the inner walls 6 are formed to conform to the shape of the first to fourth outer walls 2*a* to 2*d* and the partition wall outer wall 2*e*.

A seal element 8, which is formed from an elastic material such as rubber, is arranged along the inner surface of the first to fourth outer walls 2*a* to 2*d* and the partition wall outer wall 2*e* so as to contact the distal end of the inner walls 6. The seal element 8 extends so as to surround the cavity 2A.

Figure 5:
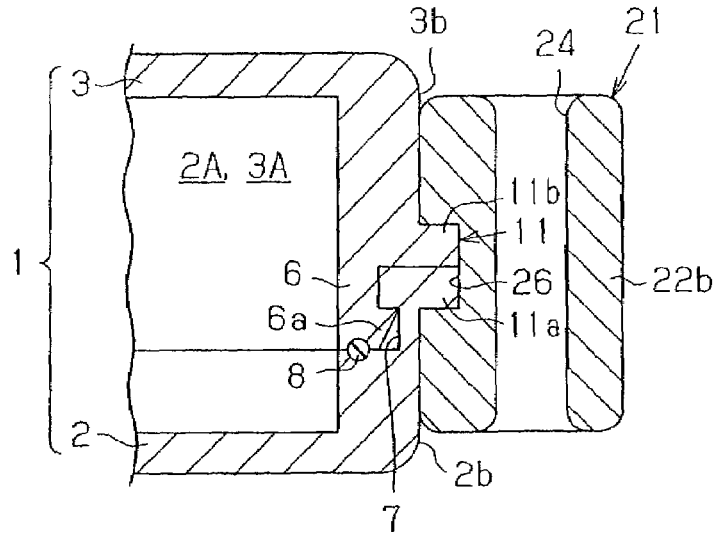
FIG. 5 is a cross-sectional view taken along line V-V in FIG. 1.

As shown in FIGS. 4 and 5, when the first and second case shells 2 are fastened to each other, the hooks 6*a* of the inner walls 6 are engaged with the associated engagement grooves 7, and the distal ends of the inner walls 6 press the seal element 8 to seal the component compartment. The hooks 6*a* and the engagement grooves 7 are engaged with each other to fasten the first and second case shells 2 and 3 to each other and function as a snap-fit structure.

Referring to FIG. 1, the case body 1 includes a mechanical key socket 9 that is open in the second outer walls 2*b* and 3*b*. In the first embodiment, the mechanical key socket 9 is an elongated hole extending along the third outer walls 2*c* and 3*c*.

More specifically, referring to FIG. 2, the first case shell 2 includes a first key slot 9*a* defined by the third outer wall 2*c*, the partition wall 2*e*, and a bottom wall 2*f*. The second case shell 3 includes a second key slot 9*b* defined by the third outer wall 3*c*, the partition wall 3*e*, and a bottom wall 3*f*. The first key slot 9*a* is partitioned from the cavity 3A. When the joining surfaces of the case shells 2 and 3 are in contact with each other, the first and second key slots 9*a* and 9*b* define a mechanical key socket 9.

Referring to FIGS. 1, 2, and 4, wedge-shaped projections 10*a* and 10*b* project toward the mechanical key socket 9 from the partition walls 2*e* and 3*e* of the case shells 2 and 3, respectively. The wedge-shaped projections 10*a* and 10*b* are symmetric to each other.

The wedge-shaped projections 10*a* and 10*b* each become wider at positions deeper in the mechanical key socket 9. More specifically, the wedge-shaped projection 10*a* includes a side edge 10*c* formed to be closer to the bottom wall 2*f* of the first case shell 2 at positions deeper in the mechanical key socket 9. The wedge-shaped projection 10*b* also includes a side edge 10*c* formed to be closer to the bottom wall 3*f* of the second case shell 3 at positions deeper in the mechanical key socket 9. The wedge-shaped projections 10*a* and 10*b* are integrated when the joining surfaces of the case shells 2 and 3 come into contact with each other. The integrated wedge-shaped projections 10*a* and 10*b* function as a first engagement projection 10. The first engagement projection 10 is tapered so that it is narrower at positions closer to the entrance of the mechanical key socket 9. As shown in FIG. 4, the cross-section of the first engagement projection 10 is shaped as a dovetail.

Referring to FIGS. 1, 2, and 5, the case shells 2 and 3 have elongated projections 11*a* and 11*b* formed on the outer surfaces of the second outer walls 2*b* and 3*b*, respectively. The elongated projections 11*a* and 11*b* are symmetric to each other and extend continuously from the associated wedge-shaped projections 10*a* and 10*b*. Further, the elongated projections 11*a* and 11*b* extend toward the hinge 5 to a middle portion of the second walls 2*b* and 3*b*, respectively. The elongated projections 11*a* and 11*b* are integrated when the joining surfaces of the case shells 2 and 3 come into contact with each other. The integrated elongated projections 11*a* and 11*b* function as a second engagement projection 11. The first and second engagement projections 10 and 11 are integrated with each other so as to extend across the boundary of the case shells 2 and 3. In the first embodiment, the second engagement projection 11 is perpendicular to the first engagement projection 10.

Figure 3:
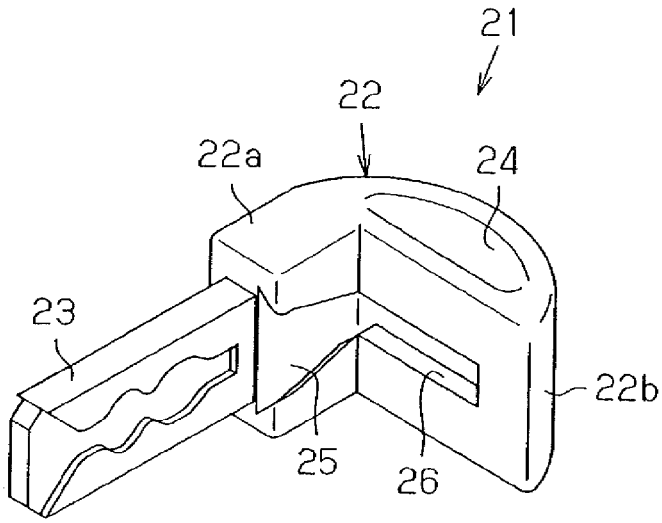
FIG. 3 is a perspective view showing a mechanical key of FIG. 1.

The mechanical key 21 is attached to the case body 1. As shown in FIG. 3, the mechanical key 21 includes a key plate 23 and an L-shaped grip 22, which is secured to one end of the key plate 23. An inner groove type key pattern is formed in the inner surface of the key plate 23. The grip 22 includes a key support 22*a*, which supports the key plate 23, and an extension 22*b*, which is perpendicular to the key support 22*a*. The extension 22*b* has a hole 24 through which an accessory, such as a strap or a key ring, may be inserted.

The grip 22 includes a first clamp portion 25 for clamping the first engagement projection 10 of the case body 1 and a second clamp portion 26 for clamping the second engagement projection 11. The first clamp portion 25 is a dovetail groove for engaging the first engagement projection and formed in the key support 22*a*. The second clamp portion 26 is an elongated groove for engaging the second engagement projection 11 and formed in the extension 22*b*. The elongated groove of the second clamp portion 26 extends continuously from the dovetail groove of the first clamp portion 25.

The cavities 2A and 3A of the case body 1 accommodates a communication apparatus such as a communication module. The communication module communicates with a drive controller, which electrically drives a lock device arranged in a door for a vehicle or a house, to remotely control the key device via the drive controller. The communication module provides the portable device with a function for remotely controlling the drive controller. Accordingly, the portable device of the preferred embodiment includes the case body 1, the mechanical key 21, and the communication module.

The mechanical key 21 is used to mechanically lock and unlock the lock device. In the first embodiment, the mechanical key 21 is an emergency key used during emergencies, such as when battery drainage occurs in the portable device, and is normally attached to the case body 1. The mechanical key 21, when attached to the case body 1, functions as a fastener for preventing the case shells 2 and 3 from falling apart in an unexpected manner. Further, the mechanical key 21 functions as a plug for closing the opening of the mechanical key socket 9.

The procedures for assembling the case body 1 and the mechanical key 21 will now be described.

In the state shown in FIG. 2, when starting the assembly, the communication module is first accommodated in the cavity 2A of the first case shell 2 (or the cavity 3A of the second case shell 3). The second case shell 3 is then pivoted about the hinge 5. The hooks 6*a* of the inner walls 6 are engaged with the engagement grooves 7 to fasten the case shells 2 and 3 to each other. The joining surfaces of the two case shells 2 and 3 come into contact with each other to elastically deform the seal element 8 with the inner walls 6 (refer to FIG. 4).

The key plate 23 and the key support 22*a* of the mechanical key 21 are inserted into the mechanical key socket 9. The insertion of the key support 22*a* into the mechanical key socket 9 results in the first clamp portion 25 receiving and holding the first engagement projection 10 of the case body 1 (refer to FIG. 4). The second clamp portion 26 of the extension 22*b* is fitted to the second engagement projection 11 of the case body 1 (refer to FIG. 5). In this manner, the engagement projections 10 and 11 are respectively held by the clamp portions 25 and 26. Since the mechanical key 21 holds projections on two surfaces of the case body 1, the assembly rigidity of the first and second case shells 2 and 3 is high.

The first embodiment has the advantages described below.

(1) The first and second case shells 2 and 3 are integrated with each other by the engagement between the hooks 6*a* and the engagement grooves 7 and the mechanical key 21 holding the first and second engagement projections 10 and 11. This securely connects the two case shells 2 and 3 and prevents the first and second case shells 2 and 3 from falling apart in an unexpected manner. Further, the fastening and loosening of fasteners, such as screws, are unnecessary. This facilitates the assembly and disassembly of the two case shells 2 and 3. Thus, maintenance of the communication module accommodated in the case body 1 is simplified.

(2) The wedge-shaped projections 10*a* and 10*b* and the elongated projections 11*a* and 11*b* function as the first and second engagement projections 10 and 11 only when the joining surfaces of the two case shells 2 and 3 come into contact with each other. For example, as long as the hooks 6*a* of the first case shell 2 are not completely engaged with the engagement grooves 7 of the second case shell 3, the clamp portions 25 and 26 cannot hold the engagement projections 10 and 11. Thus, the mechanical key 21 cannot be attached to the case body 1. The hooks 6*a* may be checked to determine whether they are completely engaging the engagement grooves 7 by determining whether the mechanical key 21 can be attached to the case body 1. In other words, the attachment of the mechanical key 21 to the case body 1 prevents incomplete engagement of the hooks 6*a* and the engagement grooves 7.

(3) The seal element 8, which is formed from an elastic body, is arranged between the first case shell 2 and the second case shell 3. When the case shells 2 and 3 are fastened together, the distal ends of the inner walls 6 press the seal element 8. Thus, the seal element 8 ensures the sealing of the cavities 2A and 3A. This ensures that moisture and dust are prevented from entering the cavities 2A and 3A.

The engagement between the mechanical key 21 and the first and second engagement projections 10 and 11 receive the reaction force of the seal element 8. This reduces the reaction force of the seal element that acts on the hooks 6*a* and the engagement grooves 7. Thus, creep deformation does not occur in the inner walls 6 and the engagement grooves 7, and the fastening force of the two case shells 2 and 3 is prevented from being decreased.

(4) The first and second engagement projections 10 and 11 are formed on the first and second case shells 2 and 3 along two adjacent surfaces (i.e., on walls 2*b* and 2*e* and walls 3*b* and 3*e*) that are perpendicular to each other. The mechanical key 21 holds the engagement projections 10 and 11, which is formed on the two surfaces. This securely fastens the first and second case shells 2 and 3 to each other.

(5) The hinge 5 connects the first and second case shells 2 and 3 to each other. Thus, the two case shells 2 and 3 are not separated from each other. Further, the engagement projections 10 and 11 are formed on the two case shells 2 and 3 at positions separated from the hinge 5. Thus, the clamp portions 25 and 26 effectively and securely fasten the two case shells 2 and 3 to each other.

(6) The first engagement projection 10, which narrows at positions closer to the entrance of the mechanical key socket 9, guides the mechanical key 21. This facilitates the attachment of the mechanical key 21 to the case body 1.

(7) The first engagement projection 10 and the first clamp portion 25 have cross-sections forming a dovetail. This securely fastens the case body 1 and the mechanical key 21 to each other. Thus, the mechanical key 21 is prevented from falling out of the case body 1 in an unexpected manner.

It should be apparent to those skilled in the art that the present invention may be embodied in many other specific forms without departing from the spirit or scope of the invention. Particularly, it should be understood that the present invention may be embodied in the following forms.

Figure 6:
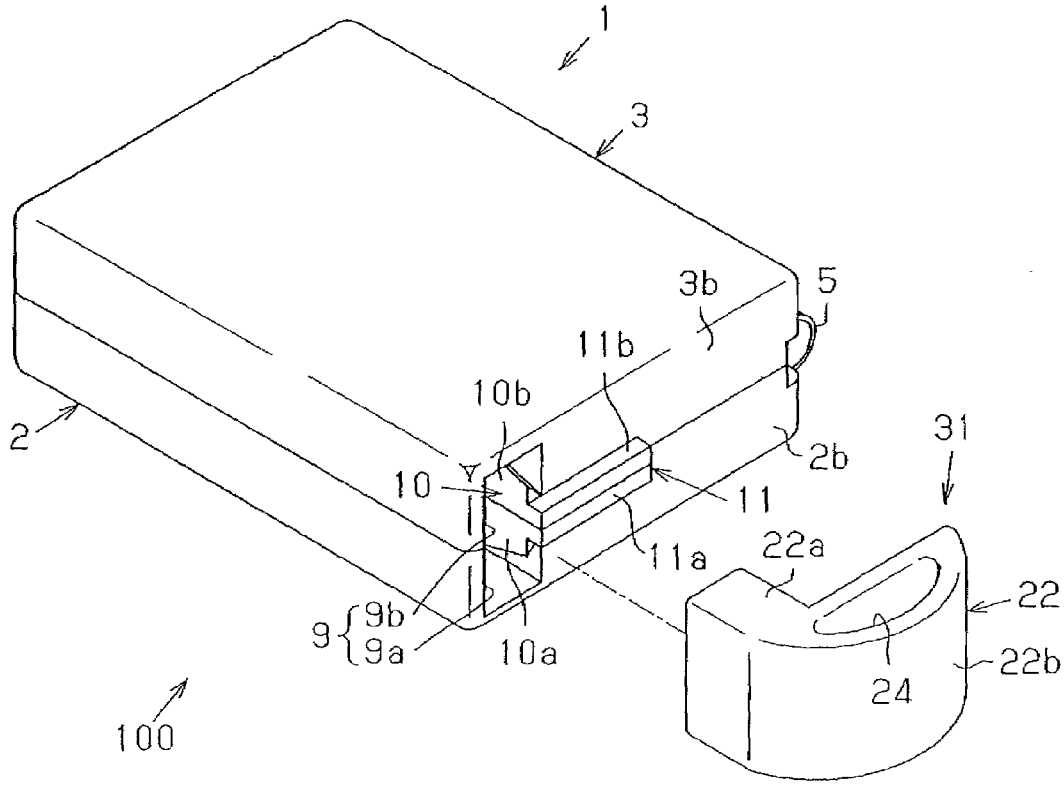
FIG. 6 is a perspective view showing a portable device according to second embodiment of the present invention.

Referring to FIG. 6, in a second embodiment according to the present invention, a grip 22 having a hole 24, through which an accessory, such as a strap or a key ring may be inserted, is used in lieu of the mechanical key 21. The grip 22 serves as a plug attachment 31 detachably attached to the case body 1 and is partially received in the socket 9. When the plug attachment 31 is attached to the case body 1, the clamp portions 25 and 26 of the plug attachment 31 hold the engagement projections 10 and 11 of the first and second case shells 2 and 3. In other words, the portable device does not have to be provided with the mechanical key 21 as long as it is provided with a component having the clamp portions 25 and 26.

Figure 7A:
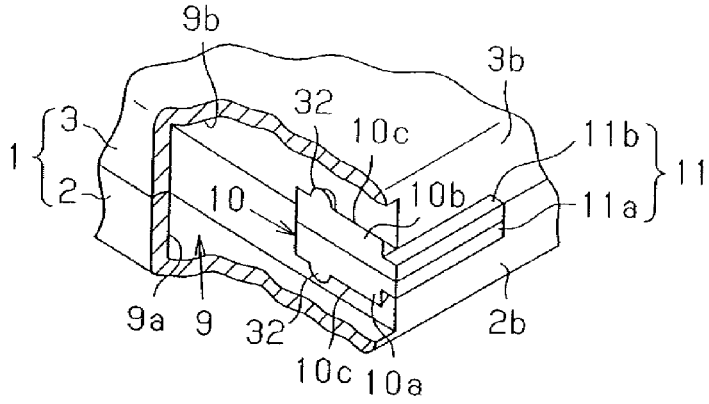
FIG. 7A is a partially cutaway perspective view showing a case body according to a third embodiment of the present invention.
Figure 7B:
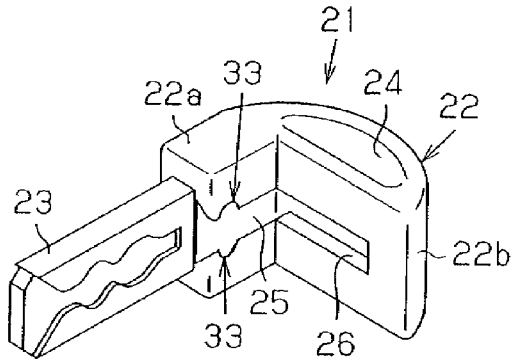
FIG. 7B is a perspective view showing a mechanical key in the third embodiment of the present invention.

Referring to FIG. 7A, in a third embodiment according to the present invention, engagement structures 32 and 33 engaged with each other are respectively added to the first engagement projection 10 and the first clamp portion 25. More specifically, tabs 32 extend from the side edges 10*c* of the two projections 10*a* and 10*b*. As shown in FIG. 7B, the first clamp portion 25 of the mechanical key 21 includes notches 33, which are engaged with the tabs 32. In the third embodiment, the tabs 32 are engaged with the notches 33 when attaching the mechanical key 21 to the case body 1. This prevents the mechanical key 21 from falling out of the case body 1. Thus, the first and second case shells 2 and 3 do not fall apart in an unexpected manner.

Figure 8A:
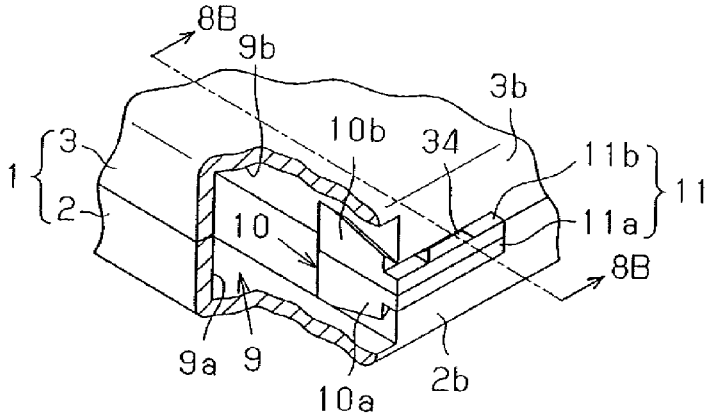
FIG. 8A is a partially cutaway perspective view showing a case body according to a fourth embodiment of the present invention.
Figure 8B:
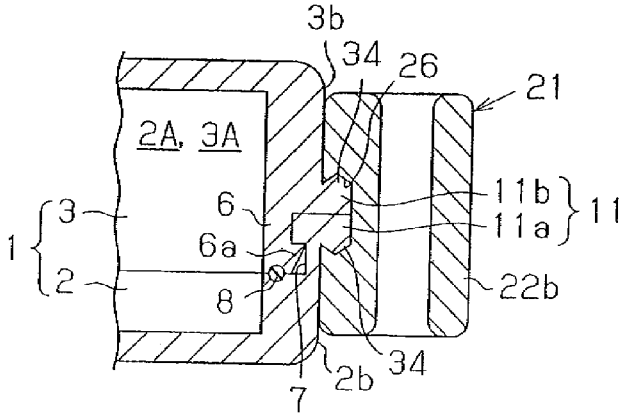
FIG. 8B is a cross-sectional view taken along line 8B-8B in FIG. 8A.

Referring to FIGS. 8A and 8B, in a fourth embodiment according to the present invention, an engagement structure 34 is added to the second engagement projection 11 and the second clamp portion 26. More specifically, projections 34 are formed on the outer surfaces of the elongated projections 11*a* and 11*b*. The second clamp portion 26 includes V-shaped grooves for engaging the projections 34. In the fourth embodiment, the projections 34 of the second engagement projection 11 engage the V-shaped grooves of the second clamp portion 26 when the mechanical key 21 is attached to the case body 1. This prevents the mechanical key 21 from falling out of the case body 1. Thus, the first and second case shells 2 and 3 do not fall apart in an unexpected manner.

Figure 9:
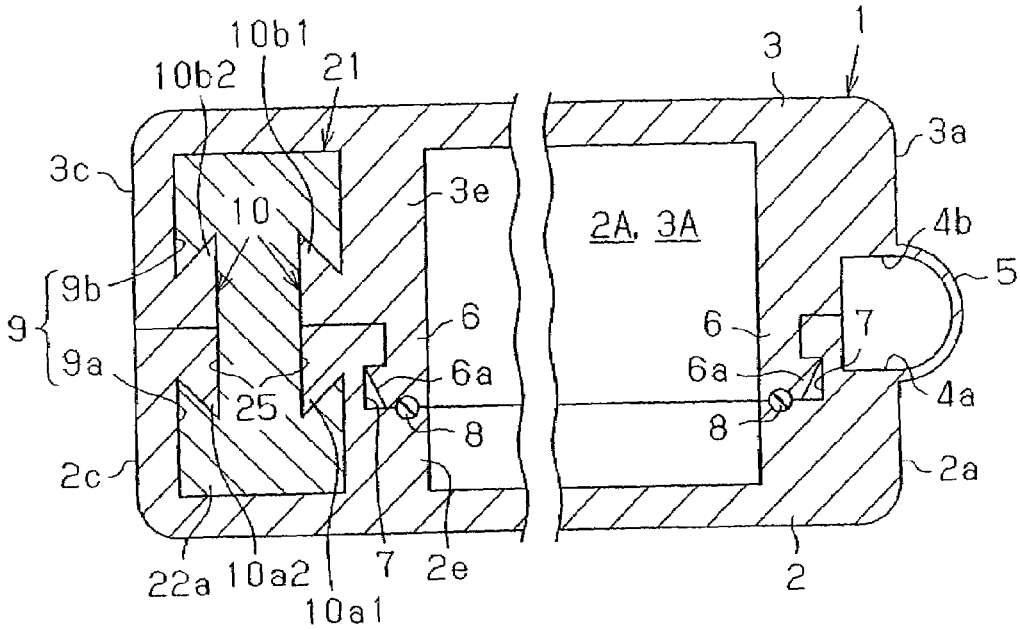
FIG. 9 is a cross-sectional view showing a case of a portable device according to a fifth embodiment of the present invention.

Referring to FIG. 9, in a fifth embodiment according to the present invention, the first case shell 2 includes two wedge-shaped projections 10*a*1 and 10*a*2 exposed to the key slot 9*a*. The wedge-shaped projections 10*a*1 and 10*a*2 face toward each other. The second case shell 3 includes two wedge-shaped projections 10*b*1 and 10*b*2 exposed to the key slot 9*a*. The wedge-shaped shaped projections 10*b*1 and 10*b*2 face toward each other. In the fifth embodiment, the first engagement projection 10 and the first clamp portion 25 are each formed at two locations. Thus, the case shells 2 and 3, to which the mechanical key 21 is attached, are rigidly fastened to each other.

In the first embodiment, the mechanical key 21 holds the engagement projections 10 and 11, which are formed along two adjacent surfaces (i.e., on walls 2*b* and 2*e* and walls 3*b* and 3*e*) of the case body 1. However, one of the engagement projections 10 and 11 (e.g., second engagement projection 11) may be eliminated. In this case, the mechanical key 21 holds only the engagement projection 10, which is formed on one surface of the case body 1.

Figure 10A:
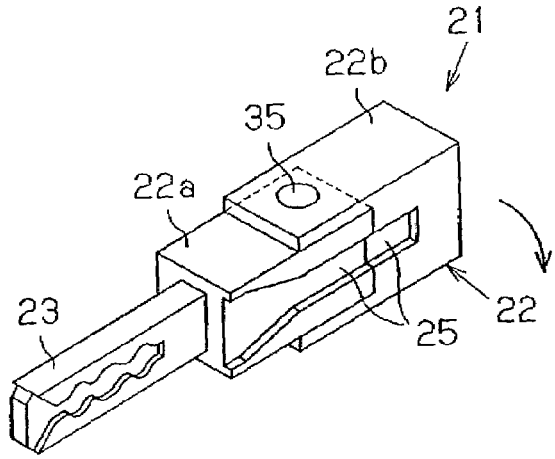
FIGS. 10A and 10B are perspective views showing modifications of mechanical keys.
Figure 10B:
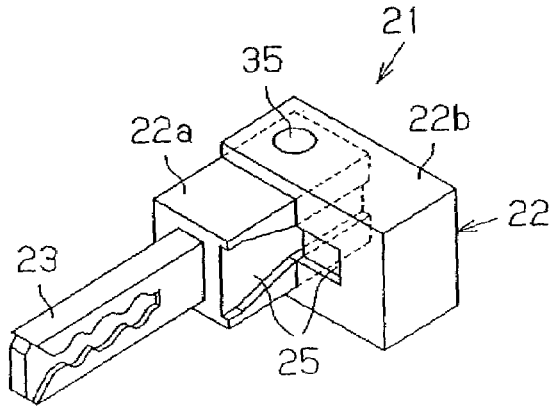

The grip 22 of the first to fifth embodiments may be modified as shown in FIGS. 10A and 10B. For example, the mechanical key 21 may include a key support 22*a*, an extension 22*b*, a grip 22 having a pivot shaft 35 for supporting the key support 22*a* and the extension 22*b* in a manner that they are relatively pivotable to each other, and a key plate 23. A first clamp portion 25 is formed on the key support 22*a* and the extension 22*b* to hold the first engagement projection 10. In this case, most of the mechanical key 21 is received in the mechanical key socket 9. Thus, the size of the portable device may be reduced. Further, during use of the mechanical key 21, the extension 22*b* is pivoted so that it becomes perpendicular to the key support 22*a* as shown in FIG. 10B. This enables the mechanical key 21 to be easily gripped so that key operations may be easily performed.

In each of the above embodiments, a third engagement projection may be formed in addition to the first and second engagement projections 10 and 11, which are formed along two adjacent surfaces (i.e., on walls 2*b* and 2*e* and walls 3*b* and 3*e*) of the case body 1. The third engagement projection may be formed on, for example, the first outer walls 2*a* and 3*a* of the case shells 2 and 3. In this case, the shape for the grip 22 of the mechanical key 21 is changed to cover the first outer walls 2*a* and 3*a* so as to hold the first to third engagement projections. Further, the hinge 5 is relocated to the fourth outer walls 2*d* and 3*d* so that the hinge 5 is not covered by the mechanical key 21. Accordingly, the mechanical key 21 holds projections formed on three surfaces of the case body 1. This further securely fastens the case shells 2 and 3 to each other.

In each of the above embodiments, the first and second case shells 2 and 3 are connected to each other by the hinge 5. However, the hinge 5 may be eliminated.

In each of the above embodiments, the first engagement projection 10 does not have to be tapered so that it narrows at positions closer to the entrance of the mechanical key socket 9. Instead of being tapered, the first engagement projection 10 may be rectangular as shown in FIG. 7A.

In each of the above embodiments, the partition walls 2*e* and 3*e*, which are formed on the first and second case shells 2 and 3, partition the mechanical key socket 9 and the component compartment. However, the partition walls 2*e* and 3*e* and the mechanical key socket 9 may be eliminated. In this case, the first engagement projection 10 is arranged on the third outer walls 2*c* and 3*c* of the case shells 2 and 3.

In each of the above embodiments, it is preferred that the projections 10*a* and 10*b* contact each other and the projections 11*a* and 11*b* contact each other. However, the projections 10*a*, 10*b*, 11*a*, and 11*b* may be formed so that a gap is formed between the projections 10*a* and 10*b* and between the projections 11*a* and 11*b*. In this case, the clamp portions 25 and 26 hold the slightly separated projections 10*a* and 10*b* and projections 11*a* and 11*b* to securely fasten the case shells 2 and 3 to each other.

The present examples and embodiments are to be considered as illustrative and not restrictive, and the invention is not to be limited to the details given herein, but may be modified within the scope and equivalence of the appended claims.

What is claimed is:

1. A case for a portable device, in which the portable device includes a communication apparatus for communicating with a drive controller that electronically locks and unlocks a lock device to remotely control the lock device, the case comprising:

a case body including a component compartment, for accommodating the communication apparatus, and a socket, having an opening, the case body being formed by fastening a first case shell and a second case shell, which have a snap-fit structure, to each other, the first case shell having an outer projection formed on an outer surface of the first case shell and the second case shell having an outer projection formed on an outer surface of the second case shell, wherein when the first and second case shells are fastened to each other, the outer projections of the first and second case shells are integrated and form an engagement projection near the opening of the socket and extending across a boundary between the first and second case shells;

an attachment detachably attached to the case body, the attachment being partially received in the socket; and a clamp portion arranged on the attachment for clamping the engagement projection that is formed by integrating the outer projections of the first and second case shells, the clamp portion including a groove with which the engagement projection is engaged when the attachment is received in the socket.

2. The case according to claim 1, wherein:

the first case shell includes a first side surface, in which the opening of the socket is formed, and a first perpendicular surface, extending continuously from and perpendicular to the first side surface;

the second case shell includes a second side surface, in which the opening of the socket is formed, and a second perpendicular surface, extending continuously from and perpendicular to the second side surface;

the engagement projection includes a plurality of first projections, formed on the first side surface and first perpendicular surface of the first case shell, and a plurality of second projections, formed on the second side surface and second perpendicular surface of the second case shell; and the clamp portion clamps the first and second projections.

3. The case according to claim 2, wherein:

the clamp portion includes a first holding groove, for clamping the first projections, and a second holding groove, for clamping the second projections; and either one of the first projections and the second projections are guided along and held by the associated holding groove; and the other one of the first projections and the second projections are engaged with and held by the associated holding groove.

4. The case according to claim 1, further comprising:

an engagement structure arranged on the engagement projection and the clamp portion for keeping the engagement projection in a state held by the clamp portion.

5. The case according to claim 1, further comprising:

a hinge formed at a position separated from the engagement projection for pivotally connecting the first and second case shells.

6. The case according to claim 1, wherein the engagement projection and the clamp portion include a dovetail for connecting the engagement projection and the clamp portion to each other.

7. The case according to claim 1, further comprising:

an elastic seal element arranged between the first case shell and the second case shell.

8. A case for a portable remote control key, in which the portable remote control key includes a communication apparatus for communicating with a drive controller that electrically locks and unlocks a lock device to remotely control the lock device, the case comprising:

a first case shell having a joining surface and a side surface;

a second case shell having a joining surface and a side surface and defining a component compartment, for accommodating the communication apparatus, and a socket, having an opening, in cooperation with the first case shell, wherein the joining surface of the second case shell comes into contact with the joining surface of the first case shell when the second case shell is fastened to the first case shell, and the side surface of the second case shell is flush with the side surface of the first case shell when the second case shell is fastened to the first case shell;

a first projection formed on the side surface of the first case shell;

a second projection formed on the side surface of the second case shell, the second projection cooperating with the first projection to form an engagement projection extending across a boundary between the first and second case shells; and a plug received in the socket to close the socket, the plug including a clamp portion for clamping the engagement projection that is formed by integrating the first and second projections of the first and second case shells to fasten the first and second case shells each other, the clamp portion including a groove with which the engagement projection is engaged when the plug is received in the socket.

9. The case according to claim 8, wherein the plug is an attachment including the clamp portion and a hole for attaching an accessory.

* * * * *